US007793799B2

(12) United States Patent
Reggiani

(10) Patent No.: US 7,793,799 B2
(45) Date of Patent: Sep. 14, 2010

(54) CONTAINER FOR DISPENSING SEPARATE PRODUCTS

(76) Inventor: Fulvio Reggiani, Via Boccaccio, 25, 21049 Tradate (IT)

( * ) Notice: Subject to any disclaimer, the term of this patent is extended or adjusted under 35 U.S.C. 154(b) by 380 days.

(21) Appl. No.: 10/932,069

(22) Filed: Sep. 2, 2004

(65) Prior Publication Data

US 2005/0127100 A1 Jun. 16, 2005

(30) Foreign Application Priority Data

Dec. 12, 2003 (IT) ..... MI030588 U

(51) Int. Cl.
*B67D 7/70* (2010.01)
*B65D 1/24* (2006.01)

(52) U.S. Cl. ..... 222/135; 222/321.9; 220/526

(58) Field of Classification Search ..... 222/321.9, 222/129–137, 383.1, 94, 183, 321.7; 220/526
See application file for complete search history.

(56) References Cited

U.S. PATENT DOCUMENTS 1,904,757 A 4/1933 Watson
2,941,696 A * 6/1960 Homm ..... 222/136
3,760,986 A 9/1973 Castner et al.
5,740,947 A * 4/1998 Flaig et al. ..... 222/135
5,769,275 A * 6/1998 Boehmer et al. ..... 222/136
5,881,918 A * 3/1999 Eichler ..... 222/135
5,967,372 A * 10/1999 Favre ..... 222/137
6,131,760 A * 10/2000 Huang ..... 220/526
6,170,708 B1 * 1/2001 Chen et al. ..... 222/135
6,604,655 B1 * 8/2003 Lee ..... 222/135
6,672,483 B1 * 1/2004 Roy ..... 222/145.1
6,729,501 B2 * 5/2004 Peterson ..... 222/135

FOREIGN PATENT DOCUMENTS

EP 0 761 313 3/1997
GB 2 327 938 2/1999

* cited by examiner

*Primary Examiner*—Kevin P Shaver
*Assistant Examiner*—Melvin A Cartagena
(74) *Attorney, Agent, or Firm*—Louis C. Paul & Associates, PLLC

(57) ABSTRACT

A container for dispensing separate products having a container body provided with a partition that forms at least two separate compartments; a closure body is connected to the container body, can hermetically engage each one of the compartments, and forms seats for accommodating dispensing valves that draw from the compartments.

5 Claims, 7 Drawing Sheets

CONTAINER FOR DISPENSING SEPARATE PRODUCTS

BACKGROUND OF THE INVENTION

As is known, in many fields of application and particularly in the field of cosmetics it is desirable to have two separate products to be dispensed simultaneously or, optionally, at successive times, depending on the criterion of application of the product.

To solve this problem, U.S. Pat. No. 5,356,040 already disclosed a container for dispensing cosmetic products that is substantially constituted by two separate container members that are joined one another by a coupling plate.

The containers can be used simultaneously or separately and have proved to be effective very valid from a functional standpoint, but suffer the drawback of being considerably expensive due to the need to assemble a plurality components.

SUMMARY OF THE INVENTION

The aim of the invention is to solve the problem noted above, by providing a container for dispensing separate products that allows to perform both simultaneous dispensing and separate dispensing of the various products while having a single container element that can be manufactured easily.

Within this aim, an object of the invention is to provide a container that is quick and simple to assemble and that can meet all the requirements of the users.

A further object of the present invention is to provide a container that, thanks to its particular constructive characteristics, is capable of giving the greatest assurances of reliability and safety in use.

A further object of the present invention is to provide a container that can be easily manufactured starting from commonly commercially available elements and materials and that is also competitive from a merely economical standpoint.

This aim and these and other objects that will become better apparent hereinafter are achieved by a container for dispensing separate products, characterized in that it comprises a container body provided with a partition that forms at least two separate compartments, a closure body being connected to said container body, said closure body being able to hermetically engage each one of said compartments and forming seats for accommodating dispensing valves that draw from said compartments.

BRIEF DESCRIPTION OF THE DRAWINGS

Further characteristics and advantages of the invention will become better apparent from the detailed description of the container for dispensing separate products, illustrated by way of nonlimiting example in the accompanying drawings, wherein.

DESCRIPTION OF THE PREFERRED EMBODIMENTS

Figure 1:
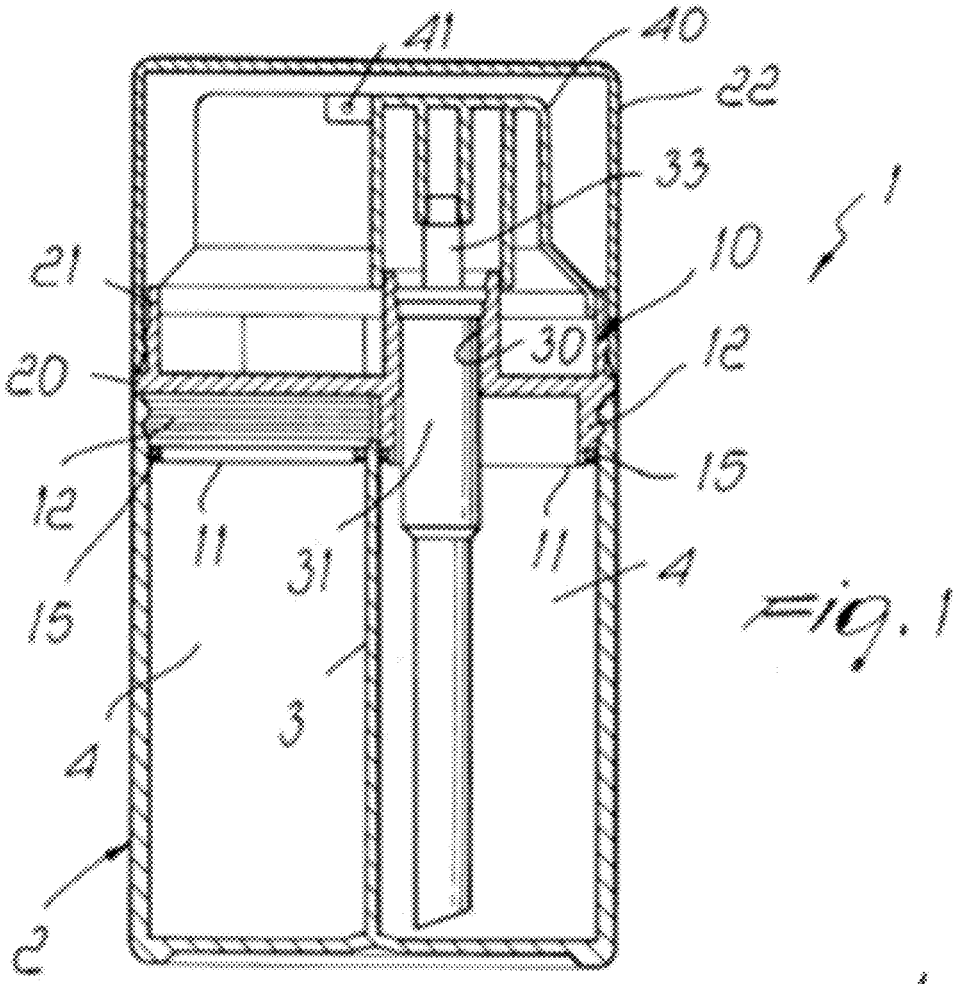
FIG. 1 is a schematic sectional view of the container according to the invention.
Figure 4:
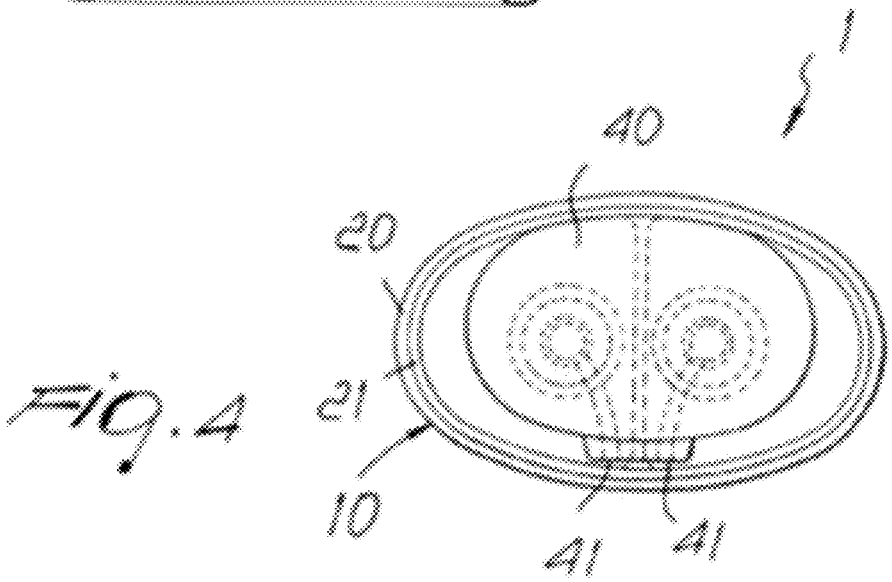
FIG. 4 is a top plan view of the container, with a single actuation button.
Figure 2:
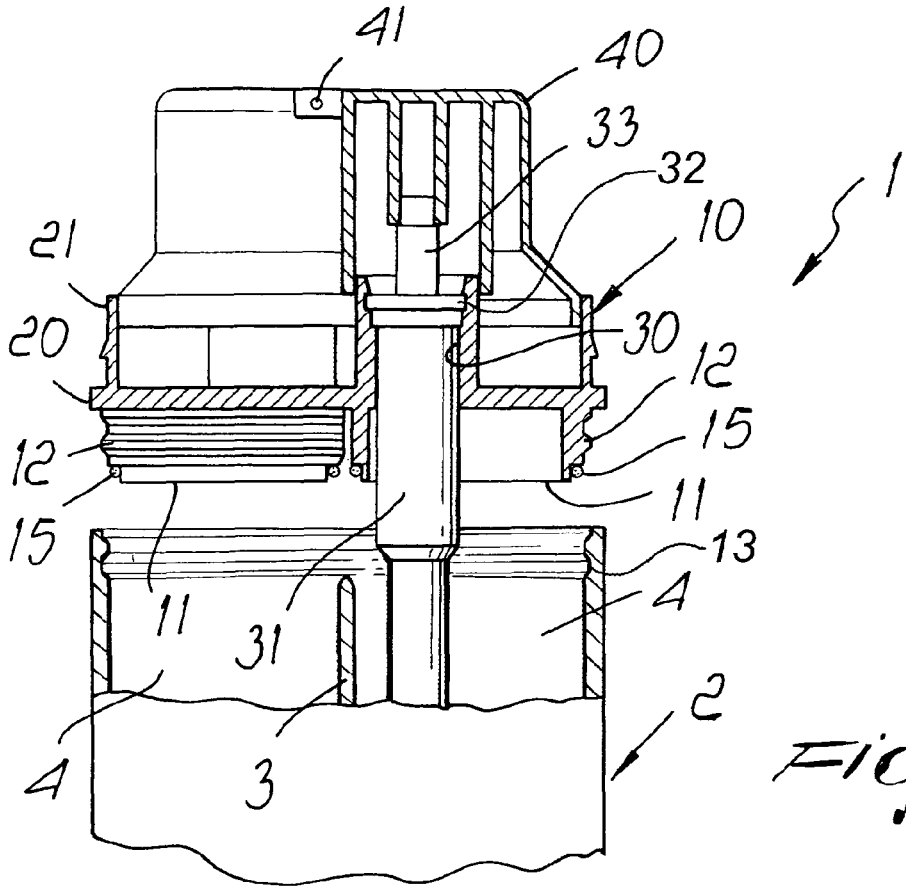
FIG. 2 is an exploded sectional view of the container according to the invention.
Figure 3:
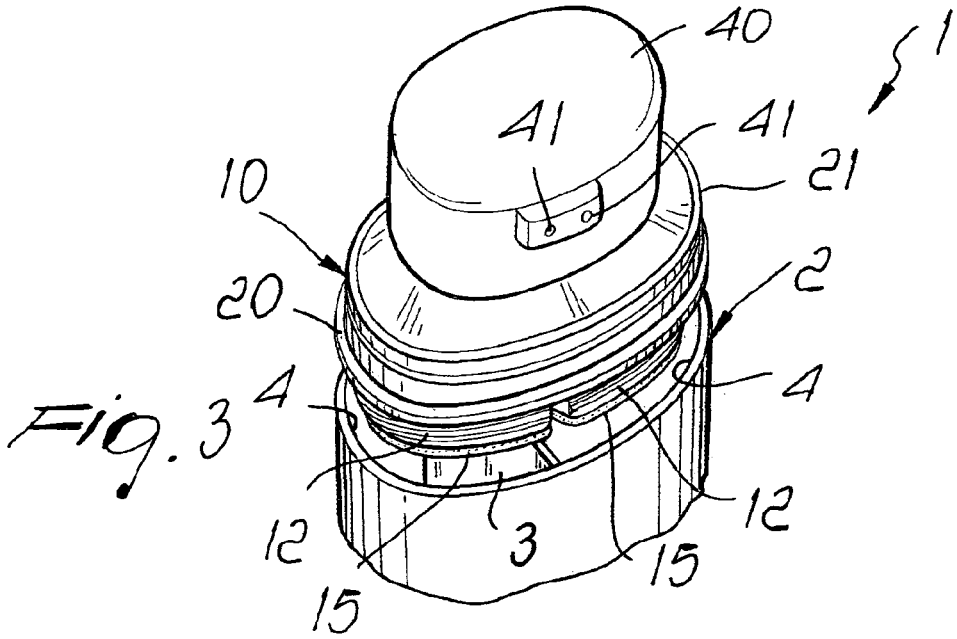
FIG. 3 is a schematic perspective view of the closure body, shown exploded with respect to the container body.

With reference to the figures, the container for dispensing separate products, according to the invention, generally designated by the reference numeral 1, comprises a container body 2, which can have any external shape deemed appropriate.

The container 2 is provided with a partition 3, which forms two separate compartments 4.

In the specific example, the container 2 has an oval shape and the partition affects the central position, thus providing two separate compartments; it is of course possible to provide a container that has another shape and the partition can be provided in various manners so as to obtain even more than two separate compartments.

An important feature of the invention consists in that a closure body is provided, generally designated by the reference numeral 10, which forms two inlets 11, which enter each compartment and are mechanically retained by way of protruding teeth 12, which mate in corresponding recesses 13 provided on the container.

At the free end of each inlet 11 an annular gasket 15, hermetically engages the internal walls of the container body 2 and of the partition 3, thus achieving a perfect seal with a single closure element that allows to separate each other the various compartments.

The closure body 10 is provided with a flange 20, which abuts against the upper rim of the container 2, and there is also an upper ridge 21, which allows coupling to a covering cap 22.

Figure 7:
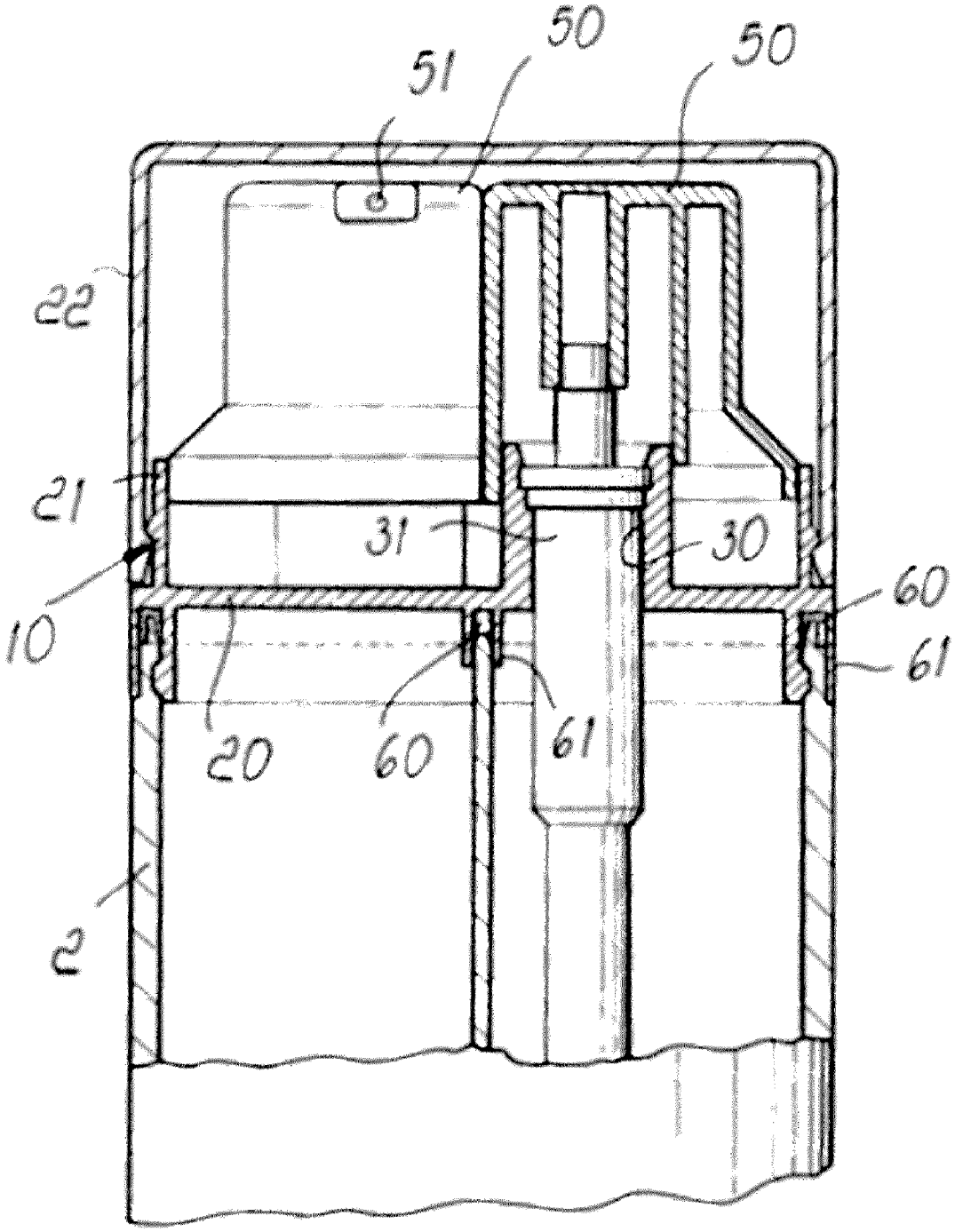
FIG. 7 is a sectional view of the container with a flat gasket between the container body and the closure body.

According to what is shown in FIG. 7, in order to provide a seal between the container body 2 and the closure body 10, a flat gasket 60 is accommodated in lower ridges 61 of the closure body 10. The ridges 61 abut over the upper rim of the container body 2 and of the partition 3.

Figure 8:
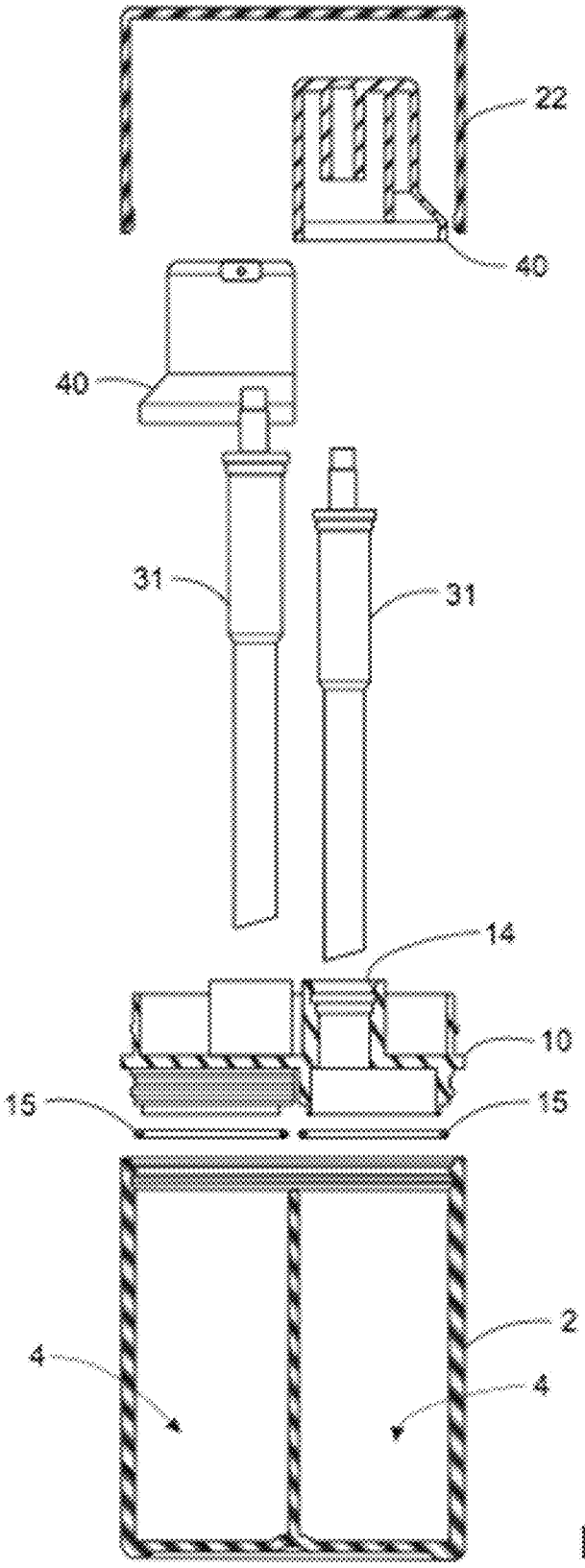
FIG. 8 is an exploded view of an embodiment of the container of the instant invention showing the separated individual elements of the container.

The seats 30 for accommodating and hermetically coupling dispensing valves 31 are provided in the interior portion of the inlets 11 formed by the closure body. The valves draw from the individual compartments and are provided, in an upper region, with a dispensing duct 33 which, in a per se known manner, is inserted in the dispensing button. As shown in FIG. 8, each of the seats has a barbed connector (14) for accommodating, and permanently coupling, each of the dispensing valves.

Dispensing valves 31 are provided with circumferential rims 32.

As visible in FIGS. 1 to 4, a dispensing button 40 allows to actuate simultaneously all the dispensing valves and is provided with separate dispensing nozzles 41 or optionally with a single dispensing nozzle into which the two dispensing ducts associated with the dispensing duct 33 merge.

Figure 5:
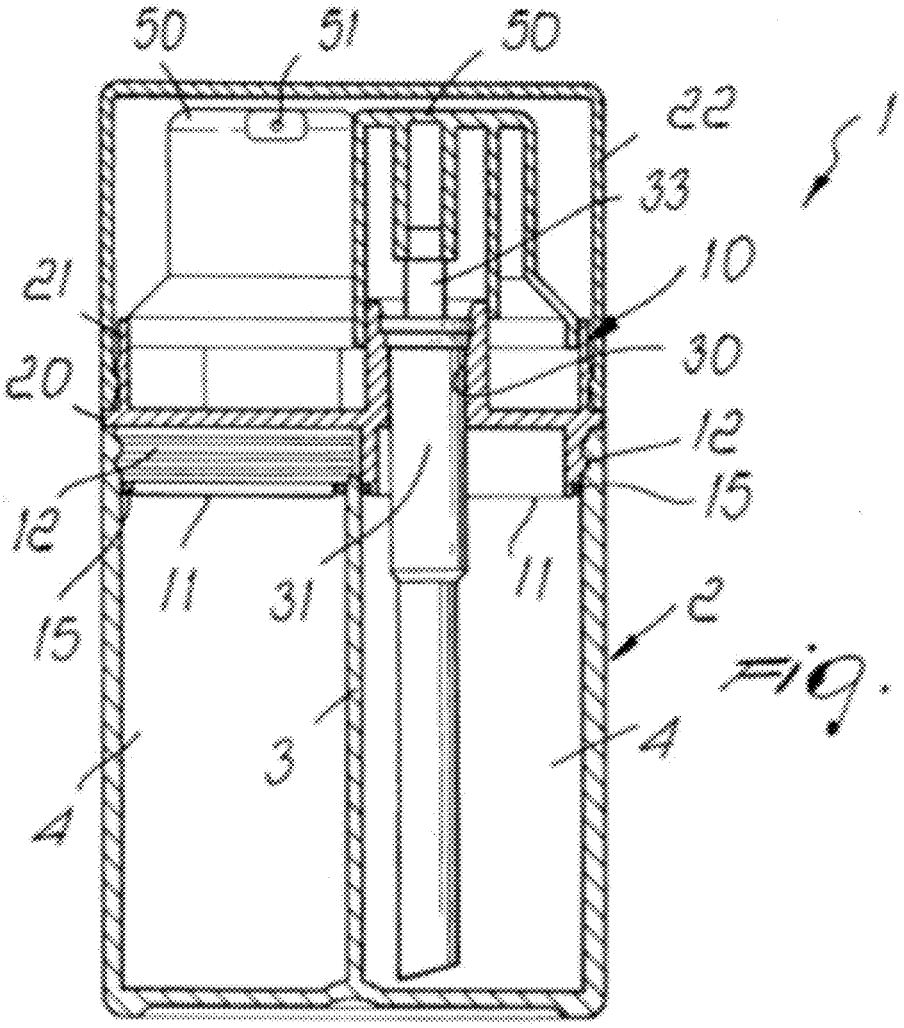
FIG. 5 is a sectional view of a container with two separate actuation buttons.
Figure 6:
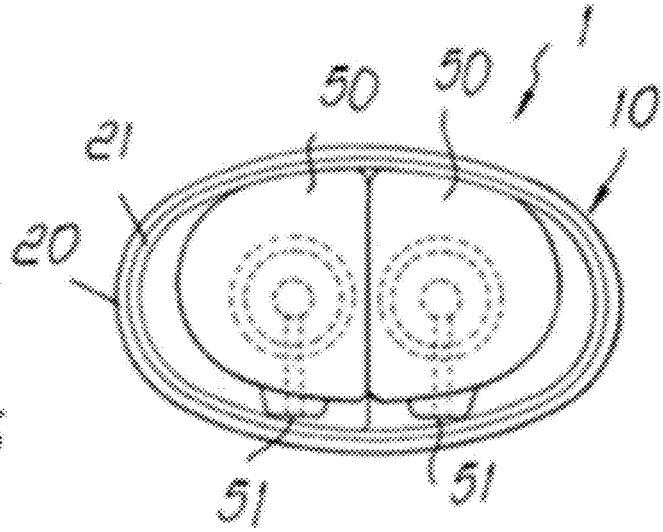
FIG. 6 is a top plan view of the container with two separate actuation buttons.

As visible in FIGS. 5 and 6, separate dispensing buttons 50 can be actuated independently of each other, and are each provided with a dispensing nozzle, designated by the reference numeral 51.

An important feature of the invention is illustrated in exploded view in FIG. 8. Specifically, the four individual elements of an embodiment of the instant invention are shown including, as recited in claim 1, (i) the container body 2, (ii) the closure body 10, (iii) the dispensing valves 31 and (iv) the "at least one" dispensing button 40. Additionally, an annular gasket 15 and covering cap 22 are shown together with the separate compartments 4 of the container body 2.

Figure 9A:
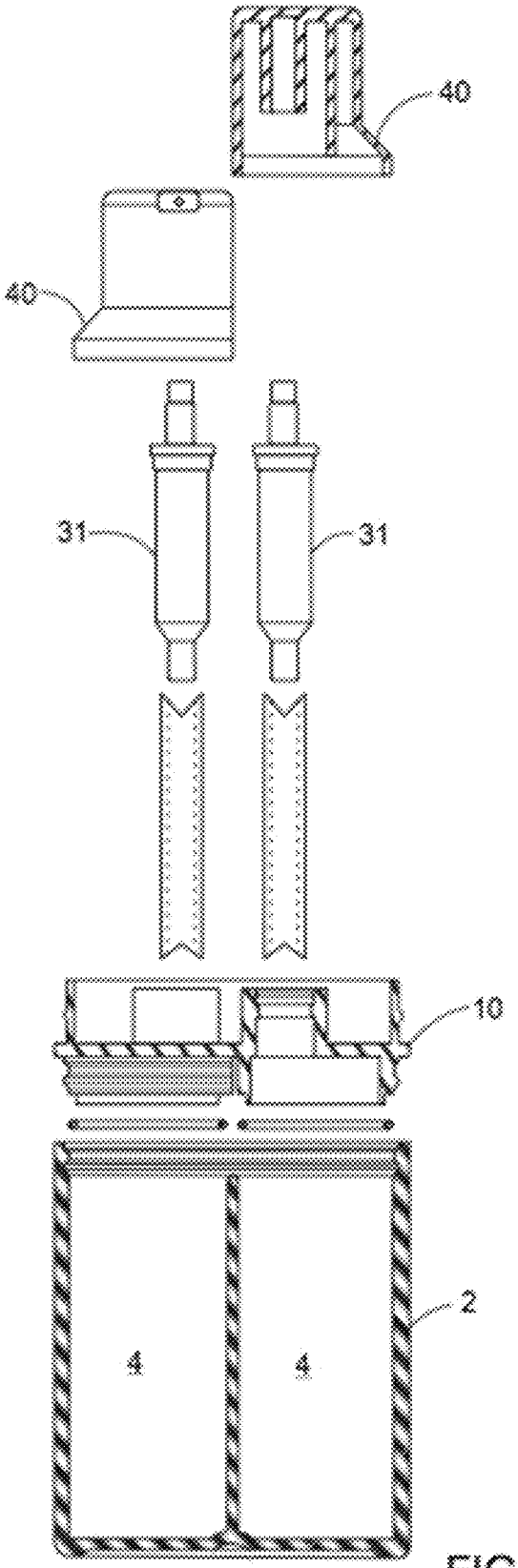
FIG. 9 is an exploded view of the container of the instant invention depicting how the separated individual elements of the container can be fit together.
Figure 9B:
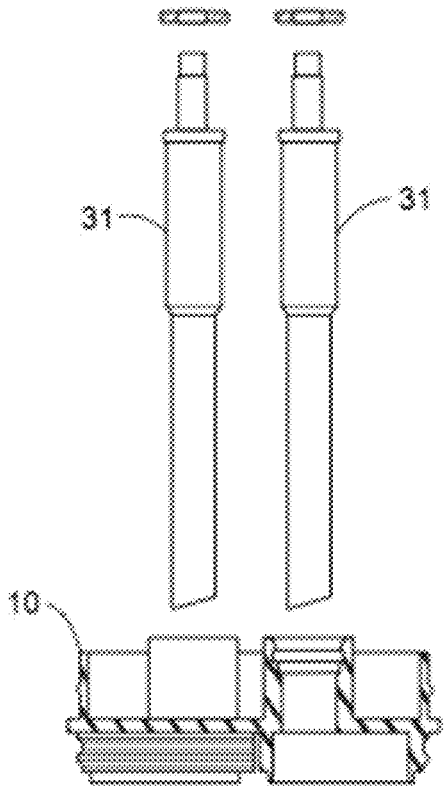

FIG. 9 depicts some of the various ways in which the dispensing valve(s) 31 of the container can be assembled into the other elements of the container. Labeled elements are as follows: the container body 2, the at least one dispensing button 40, the closure body 10, the separate compartments of the container body 4, and the at least one dispensing valve 31.

Figure 10:
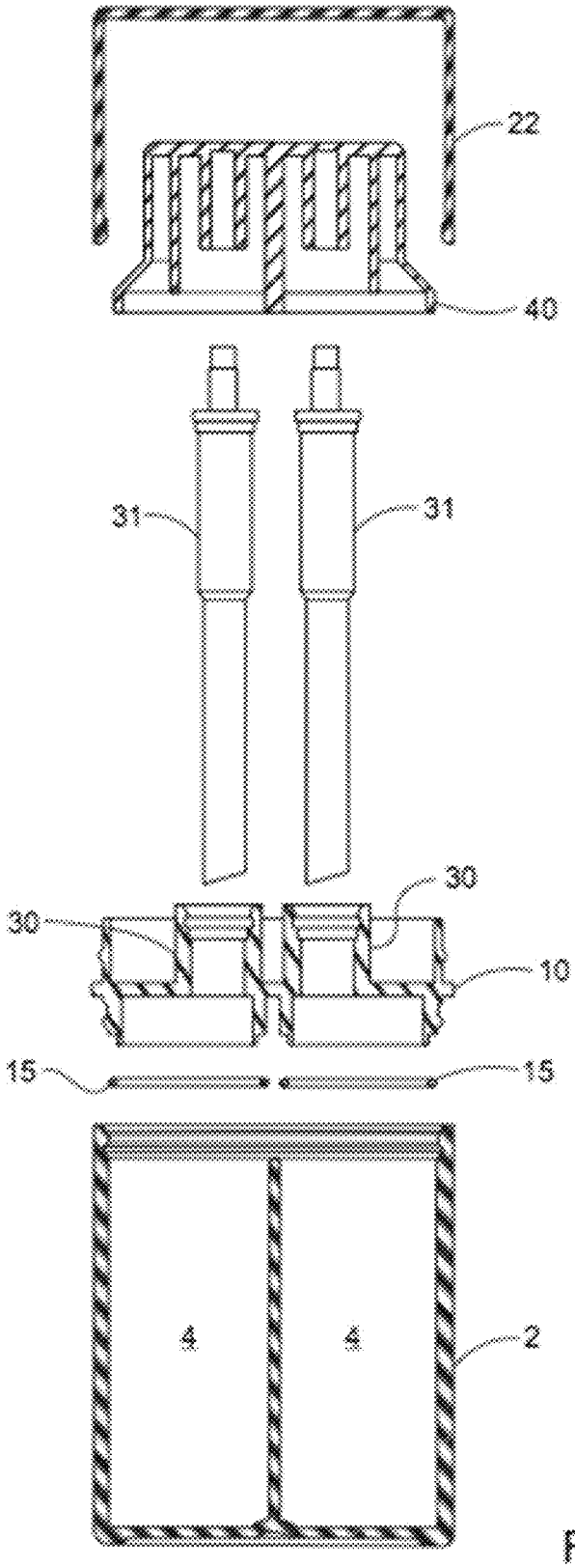
FIG. 10 is an exploded view of the container shown in FIG. 1 showing the individual elements of the container separated from each other.

FIG. 10 shows the embodiment of FIG. 1 in exploded and full-section view to illustrate the closure body 10, the seats 30, the dispensing valves 31, the covering cap 22, the separate compartments 4 of the container body 2, the annular gasket 15 and the at least one dispensing button 40.

With the arrangement described above, the container allows to have a single button for the simultaneous dispensing of two or more products and to have a plurality of mutually separate buttons that allow to dispense the products separately according to the type of use.

From what has been described above, it is thus evident that the invention achieves the intended aim and objects, and in particular the fact is stressed that a container for dispensing separate products is provided which is structurally particularly simple and is obtained in practice by means of a single part on which a closure body is coupled which allows to hermetically separate the various compartments and to perform dispensing by using conventional dispensing valves.

In practice, the materials used, so long as they are compatible with the specific use, as well as the contingent shapes and dimensions, may be any according to requirements.

The disclosures in Italian Utility Model Application No. MI2003U000588 from which this application claims priority are incorporated herein by reference.

What is claimed is:

1. A two-chambered hermetically-sealed container for dispensing two separate products, each product contained in one of the two chambers, comprising:

(i) a unitary container body of circular or elliptical cross-section having open and closed ends and a rising wall, the open end defining a circumferential open-end surface, the unitary container body comprising (a) an integral partition defining two separate compartments in the interior of the container, and (b) proximal the open end of the container, a continuous undercut recess in an interior side of the rising wall around the entire circumference of the unitary container body;

(ii) a one-piece closure body having the same cross-section shape as the unitary container body and itself comprising (a) a circumferential flange, a first surface of which mates against the entirety of the circumferential open-end surface of the unitary container body, (b) two circular inlets forming channels into the two compartments, each inlet having a circumferential recess for receiving and hermetically coupling a dispensing valve having a circumferential rim snugly and permanently received in the circumferential recess of the respective inlet, and (c) a continuous circumferential protruding tooth snugly and permanently received in the undercut recess of the unitary container body when the flange is mated against the entirety of the circumferential open-end surface of unitary container body;

(iii) two dispensing valves, one dispensing valve received and hermetically coupled in each of the two circular inlets, and each dispensing valve having a circumferential rim snugly and permanently received in the circumferential recess of the respective inlet, each of the dispensing valves configured and dimensioned to pass through seats having a dispensing duct in fluid communication with a dispensing button;

(iv) gaskets circumferentially arranged about each circular opening, each gasket hermetically engaged with the walls of the container and partition; and (v) the dispensing button having a dispensing nozzle.

2. The container of claim 1 wherein the closure body has an upper ridge extending away from a second surface, opposite the first surface, of the flange for detachable engagement with a covering cap.

3. The container of claim 1 having two dispensing buttons, each in fluid communication with an individual corresponding dispensing duct.

4. The container of claim 1 comprising a single dispensing button in fluid communication with both dispensing ducts.

5. The container of claim 1 wherein at least one of the products to be dispensed is a cosmetic product.

* * * * *